United States Patent [19]

Shen

[11] Patent Number: 4,656,838

[45] Date of Patent: Apr. 14, 1987

[54] COOLING DEVICE FOR A CAN CONTAINING A BEVERAGE

[76] Inventor: Hwang K. Shen, No. 116, Suan Fu Chun, Ming Hsiung Hsiang, Chia Yi Hsien, Taiwan

[21] Appl. No.: 906,191

[22] Filed: Sep. 11, 1986

Related U.S. Application Data

[63] Continuation-in-part of Ser. No. 799,571, Nov. 11, 1985, abandoned.

[51] Int. Cl.[4] ..... F25D 3/10

[52] U.S. Cl. ..... 62/294; 62/457

[58] Field of Search ..... 62/4, 457, 294, 293; 220/67, 89 A

[56] References Cited

U.S. PATENT DOCUMENTS

| | | | |
|---|---|---|---|
| 2,759,337 | 8/1956 | Katz | 62/4 |
| 3,726,106 | 4/1973 | Jaeger | 62/294 |
| 3,862,548 | 1/1975 | Ladany | 62/294 |
| 4,319,464 | 3/1982 | Dodd | 62/294 X |
| 4,584,848 | 4/1986 | Barnett | 62/294 |

*Primary Examiner*—Lloyd L. King

*Attorney, Agent, or Firm*—Shoemaker and Mattare, Ltd.

[57] ABSTRACT

A cooling device for a can containing a beverage is proposed, the device having a closure formed in an end panel of the can, the closure protruding inwardly from the end panel. A suitable cooling substance in a compressed form is charged into the closure which is sealed with a cover provided with an operating lever. The operating lever has one end formed into a sharp point against the cover member. The cover can thus be punctured by manipulating the operating lever to form an orifice through the cover member to allow the pressurized cooling substance in the closure to evaporate or to expand through the orifice formed in the cover, so as to absorb heat from the can and thus cool the contents of the can.

1 Claim, 3 Drawing Figures

COOLING DEVICE FOR A CAN CONTAINING A BEVERAGE

This application is a continuation-in-part-application of U.S. patent application Ser. No. 799,571 filed on Nov. 11, 1985, which is now abandoned.

BACKGROUND OF THE INVENTION

This invention relates to a cooling device which can, when operated, be used to cool a beverage contained in a can.

Canned beverages are usually placed inside a refrigerator or a container filled with ice in order to lower the temperature and to improve the taste of the beverages before they are served to and enjoyed by the consumer/drinker. However, on some occasions a refrigerator or ice cubes may not be available and the beverages thus can not be cooled as desired. Therefore, it would be convenient if canned beverages could be cooled by a simple, compact device which is readily provided as a part of the can.

Therefore, it is the main object of this invention to offer a cooling device for a canned beverage, which is integrally provided in the can and which can be easily operated to cool the beverage contained in the can.

SUMMARY OF THE INVENTION

This invention offers a cooling device for a canned beverage in which a suitable amount of a cooling substance, such as compressed difluoro methane, dichloro methane or fluoro trichloro methane, is sealed within a closure integrally formed within the bottom end panel of the can. The closure is so formed to protrude inwardly from the bottom end panel of the can and is provided with a cover which seals the closure, the cover having an operating lever with one end formed into a sharp point against the cover. In use, the operating lever is manipulated to puncture the cover with the sharp point of the operating lever, to allow the cooling substance to evaporate or to expand into the atmosphere whereby the cooling substance is activated to cool the contents of the can.

DETAILED DESCRIPTION OF THE INVENTION

Figure 1:
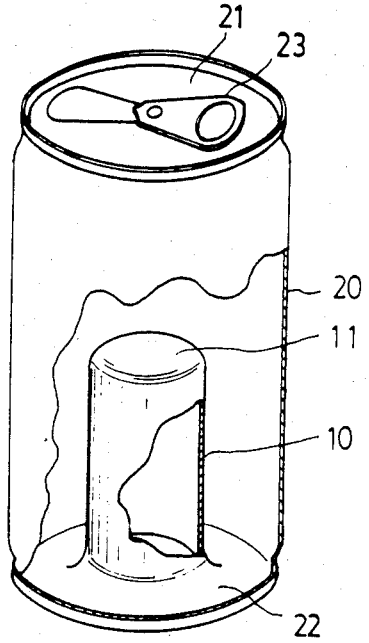
FIG. 1 is a partly sectioned, partly cut away perspective view of a can, showing a preferred embodiment of the cooling device of this invention.

In FIG. 1 there is shown a preferred embodiment of the cooling device of this invention. As shown in the drawing, the device consists of a generally cylindrical closure 10 integrally formed with a metallic bottom end panel 22 of a can 20 having an opposite, top panel 21 which is provided with a conventional pull tab capable of opening a hole in top panel 21 when pulled. Closure 10 is so formed to protrude inwardly a suitable length from bottom end panel 22, with its inner end 11 closed.

When can 20 is filled with a beverage, closure 10 is surrounded by the beverage.

Figure 2:
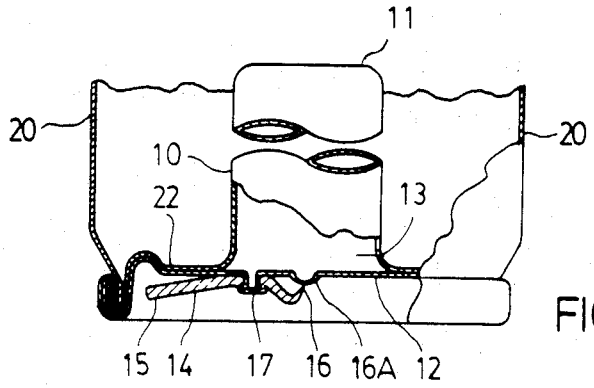
FIG. 2 is a fragmentary, cross-sectional view of the cooling device shown in FIG. 1, showing the formation of the closure for containing the cooling substance and the operating lever.
Figure 3:
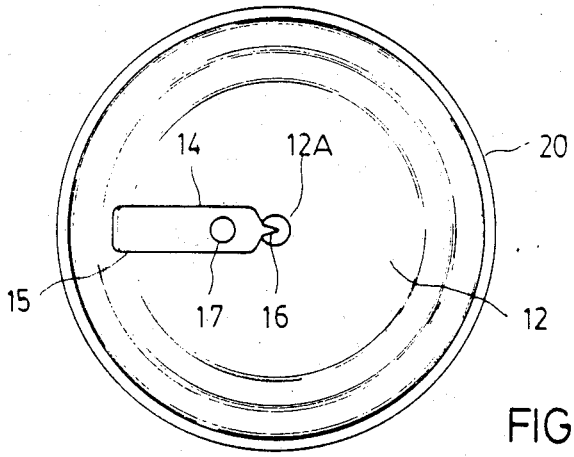
FIG. 3 is a bottom view of the can of FIG. 1, showing the configuration of the operating lever.

As shown in FIG. 2, closure 10 is provided with a cover 12 for sealing closure 10, to form a sealed compartment 13 within closure 10. Cover 12, as shown in the drawing, is securely fixed onto the bottom end panel 22 of can 20, and is provided with an operating lever 14 securely mounted onto cover 12 with a stud 17, operating lever 14 having a first end 15 extending freely from stud 17 and an opposite, second end 16 formed into a sharp point disposed against the generally central part of cover 16. A small dome 12A may be optionally formed at the central part of cover 12 to correspond with the pointed second end 16 of operating lever 14.

The first end 15 of operating lever 14 is preferably slightly slanted away from cover 12 to facilitate manipulation by fingers.

The second end 16 of operating lever 16 is preferably bent toward cover 12, or formed into a hook shape, to facilitate the piercing operation.

A suitable cooling substance, such as difluoro methane, dichloro methance or fluoro trichloro methane, in a pressurized state, is charged into the compartment 13. In use, can 10 is first placed in an upsidedown position with bottom end panel facing upwards, and then the first end 15 of operating lever 14 is pulled or jerked to cause second end 16 of operating lever 14 to pierce through the central part of cover 12, so as to form an orifice in cover 12. The pressurized cooling substance in closure 10 is thus allowed to expand or to evaporate through the orifice formed in cover 12, and the expanding cooling substance will absorb heat from the surroundings, particularly from the contents of the can, so as to cool the beverage in the can.

In the preferred embodiment as shown in FIG. 2, cover 12 and bottom end panel 22 are securely connected to the edge of the cylindrical body of can 20 by curling together the edges of cover 13 and bottom end panel 22, and the edge of the cylindrical body of can 20. However, it should be understood that other types of joining cover 12, bottom end panel 22, and the cylindrical body of can 20 may be employed.

As soon as the beverage in the can is cooled, the can may be turned again to put the top end panel facing upwards, and the cooled beverage is ready to be served by pulling the pull tab to open a hole in top panel 21.

I claim:

1. A cooling device for a can containing a beverage, said can having a metallic end panel; comprising:

a closure member integrally formed with said metallic end panel and protruding inwardly from a central part of said metallic end panel, said closure having a closed inner end for containing therein a cooling substance in compressed form, said cooling substance being capable of absorbing heat from its surroundings when allowed to expand and evaporate;

a cover for sealing said cooling substance in said closure member; and a lever securely mounted on said cover, said lever having a first free end and an opposite second end, said second end being sharply pointed and disposed against said cover and capable of piercing through said cover to form an orifice in said cover when said first end of said lever is pulled, whereby said cooling substance in said closure member is allowed to expand and to evaporate.

* * * * *